US006257159B1

(12) United States Patent
Siegmann

(10) Patent No.: US 6,257,159 B1
(45) Date of Patent: Jul. 10, 2001

(54) APPARATUS FOR RAISING AND LOWERING BOATS IN WATER

(76) Inventor: Goetz Siegmann, Muehlster.8a. D-88085, Langenargen (DE)

( * ) Notice: Subject to any disclaimer, the term of this patent is extended or adjusted under 35 U.S.C. 154(b) by 0 days.

(21) Appl. No.: 09/597,366

(22) Filed: Jun. 19, 2000

Related U.S. Application Data

(63) Continuation of application No. 09/026,046, filed on Feb. 19, 1998, now Pat. No. 6,076,478, which is a continuation-in-part of application No. 08/729,446, filed on Oct. 11, 1996, now abandoned.

(30) Foreign Application Priority Data

Oct. 12, 1995 (CH) ..... 02897/95
Aug. 20, 1996 (DE) ..... 196 33 414

(51) Int. Cl.[7] ..... B63C 1/02
(52) U.S. Cl. ..... 114/45; 114/48
(58) Field of Search ..... 114/44, 45, 263; 405/3, 7

(56) References Cited

U.S. PATENT DOCUMENTS

| | | | | |
|---|---|---|---|---|
| 3,126,855 | * | 3/1964 | Freeburg | 114/45 |
| 3,362,172 | * | 1/1968 | Rutter | 114/45 |
| 3,727,415 | * | 4/1973 | Williams | 114/45 |
| 3,895,592 | | 7/1975 | King | 114/45 |
| 4,072,119 | | 2/1978 | Williams | 114/45 |
| 4,509,446 | | 4/1985 | Sutton | 114/45 |
| 4,686,920 | * | 8/1987 | Thomas | 114/48 |
| 5,394,814 | * | 3/1995 | Rutter et al. | 114/45 |
| 6,076,478 | * | 6/2000 | Siegmann | 114/45 |

FOREIGN PATENT DOCUMENTS

| | | | |
|---|---|---|---|
| 1 634 202 | 5/1970 | (DE) . | |
| 2 260 542 | 6/1974 | (DE) | B63C/1/08 |
| 42 14 019 | 11/1993 | (DE) | B63C/1/00 |
| 9 312 336 | 12/1993 | (DE) | B63C/1/02 |
| 44 26 194 | 1/1996 | (DE) | B63C/1/00 |
| 2 588 819 | 4/1987 | (FR) | B63B/35/44 |
| WO 92/02407 * | 2/1992 | (WO) . | |

* cited by examiner

*Primary Examiner*—Ed Swinehart
(74) *Attorney, Agent, or Firm*—The Maxham Firm

(57) ABSTRACT

Apparatus for raising and lowering boats in water. The apparatus consists essentially of at least one float that is attached to the hull of the boat and is guided along the surface of the hull of the boat at least partially below water level when a force is applied to it. Preferably at least two floats that are permanently or displaceably attached to the apparatus support in the longitudinal direction and are provided on the side of the support which is intended to accommodate the hull of a boat. The entire device is designed so it is adjustable in height and is connected to a stationary land-based mooring point with an articulated joint. This device is especially reliable for raising a boat out of the water and docking the boat above the water line without risking canting. This result is possible in an inexpensive and very simple manner with the invention. The usable width of the entire device is greatly reduced from previously known such devices.

11 Claims, 11 Drawing Sheets

APPARATUS FOR RAISING AND LOWERING BOATS IN WATER

CROSS REFERENCE TO RELATED APPLICATION

This application is a continuation of application Ser. No. 09/026,046 filed on Feb. 19, 1998 now U.S. Pat. No. 6,076,478 and which designated the U.S. which is a continuation-in-part of U.S. application Ser. No. 08/729, 446, filed Oct. 11, 1996 now abandoned.

BACKGROUND

1. Field of the Invention

The invention generally concerns an apparatus for raising and lowering boats, and more particularly relates to an improvement employing flotation elements which can be raised and lowered by means of pumping water in or out, with the entire apparatus being adjustable to accommodate boats of different dimensions.

2. Discussion of the Prior Art

Apparatus of the general type to which the present invention relates is known from German patent 4,214,019, for example. According to this known publication, the hull of the ship to be raised is run onto a floating cushion that is subsequently inflated to raise the hull out of the water.

German patent 4,426,194 discloses another device for raising boats in water, where the known floating cushion principle is also combined with a magnetic holding device that is in contact with a (metallic) ship's hull and is secured there with suitable magnetic plates.

German utility model GM 9,312,336 concerns another device that is also based on the principle of a float that can be flooded and vented.

All these known apparatuses have in common the fact that their object is to raise a hull floating in water out of the water so the hull is raised above the water line while docked.

This concept offers some major advantages for winter boat storage since boats that are used with the known devices need no longer be dry docked. Likewise, these designs also have advantages because the underwater paint is exposed to water only when the hull is actually in use.

However, the known devices have the disadvantage that they do not keep the hull safe enough from accidents. In particular, there is a lack of stability when pumping up a boat—in other words, when lifting the hull out of the water.

Especially with the device according to German patent 4,214,019, the center of gravity of the boat is precisely in the middle of the inflatable cushions, which has the disadvantage that when the hull is lifted, it tends to tilt to the side.

A disadvantage of German patent 4,426,194 is that the float should be in contact with the outside of the hull, thus leading to a great increase in the total required width of the entire device, which consequently takes up a great deal of space in the water, although that is not desirable.

SUMMARY OF THE INVENTION

A primary purpose of this invention is therefore to improve on a device of the above-mentioned type so that a boat can be raised out of water reliably, much more easily and less expensively, so that the boat can be docked above the water line (without any danger of canting), and furthermore the usable width of the device as a whole is greatly reduced.

An important feature of the invention is that now at least two floats are provided at the sides of a support that is intended for accommodating the keel in the longitudinal direction. These floats are connected to the support in a stationary or displaceable mount and the entire device is secured to a mooring point in such a way that it is adjustable in height.

This improvement to the conventional technical teaching has the important advantage that the support mentioned above is now connected at the side directly to corresponding floats running longitudinally. This yields the advantage that the support is used almost exclusively to accommodate the keel part of the boat, and the floats connected to it can be in direct contact with this area of the keel, so this greatly reduces the resulting width of the device.

This yields the further advantage that the entire device corresponds essentially only to the width of the boat, because the floats below the ship are in contact with the ship's hull in the area of or next to the keel line and it is no longer necessary for these floats to be in contact with the side walls of the ship's hull.

In a preferred embodiment of the present invention, the connection between the support that accommodates the keel and the respective floats that are held in a separate framework is designed to be adjustable in height. This results in the important advantage that the height of lift of the hull out of the water can be adjusted with this adjustable height option. This makes it possible to design the support to accommodate keel boats (such as sailboats) but also (with an appropriate reduction in the depth of immersion) this support can also be adjusted to accommodate motor boats with a relatively shallow keel in water. Thus, this support is intended to accommodate mainly leisure boats, such as motor boats, sailboats, rowboats, pedal boats, etc.

Another important feature of this invention is that now the device according to this invention is designed for being attached to adjacent devices at the side. In other words. several similar devices are joined at the sides in such a way that they are adjustable in height (so they can be displaced vertically relative to each other), and these units float in water independently of each other and are designed to be submersible and liftable, but fact that one device is connected to the next device at the side has the advantage that on the whole the devices are protected from lateral canting, and the canting protection of such a device is greatly improved in this way.

It is important here for the devices that are positioned side by side to be connected to each other in such a way that each device can move vertically in the water independently of the others. so appropriate displacement guides are provided for this purpose and may consist of suitable roller guides, for example, where a suitable roller arrangement is provided on one device to engage in a vertical track in the neighboring device.

Another embodiment of this height adjustment device consists of the fact that a suitable dovetail guide is provided to engage in a matching guide in the neighboring device. Likewise. tongue-and-groove devices or similar methods of engagement are also provided.

When the apparatus of the invention is being used, the floats are first flooded and the entire device is below the water line such that the support for accommodating the keel of a corresponding float is lowered just as deeply in the water. In this submerged position, the pillars, which are now preferably provided only at the mounts for the floats, project out of the water. These pillars are also preferably each provided with a hand rail running longitudinally. Thus, this is a type of boat dock that, when submerged, can be recognized only by its pillars projecting vertically out of the water and the optional hand rails running parallel to the water surface.

The ship's hull to be raised is first guided into the submerged device, where the pillars arranged on both sides assure that the hull is centered well over the submerged support, and at the same time the ship can also be secured to the pillars. However, this invention is not limited to the use of such pillars, which could be eliminated.

It is also assumed here that the entire device is tied to a relatively stationary point (mooring point). Such a mooring point may be a pier, a buoy, a floating jetty, a pile, etc. It is also preferable if the entire device is attached to this pier or mooring point in such a way that it is adjustable in height so a constant relationship of the device to the stationary mooring point can be achieved at all times. This connection is preferably designed with an articulated joint or at least so it is adjustable in height to assure that the connection to this mooring point will be maintained even when the device is submerged.

Once the hull has been guided into the submerged device, it is no longer necessary to tie the hull to the side pillars because it is sufficient to center the hull between the pillars. Furthermore. it is not essential to this invention for the pillars to be in contact with the hull.

As soon as the hull has been centered on the device, several pumps that are suitable for emptying the floats that were previously filled with water and are started and pump the water out of these floats. These are preferably inexpensive electric submersible pumps that are available in several designs.

The floats may be subdivided into several successive compartments, where a submersible pump is provided for each compartment. This makes it possible to flood individual segments of the floats, so it is possible to adjust a certain inclined position of the device submerged in water. This also makes it possible to adjust the floating level of the device submerged in water, just as the floating level of the device out of water can also be adjusted later.

Operating the submersible pumps thus removes the water from the floats in order to assure a precisely defined floating level of the entire device in water. The hull is then raised out of the water and lifts the body of the ship out of the water. In summer, the keel and the rudder will remain in the water, whereas in the winter the height adjustment device on the support can be adjusted so that all underwater parts of the hull can be completely raised out of the water. This has the advantage that the apparatus (as a boat dock) can remain in water and the entire boat hull has a winter dock in water.

Therefore, this device has the advantage that in summer the underwater hull of the boat comes in contact with water only when the boat is actually in operation, but the underwater hull does not come in contact with water for the remainder of the docking time. This prevents the environmentally harmful antifoulin paints from coming in contact with water except when the hull is actually being used for leisure and sports purposes.

Another advantage of this invention is that only additional fastening devices for tarpaulins or canvas can be attached to the hand rails, thus resulting in a floatable and submersible boat dock. Therefore, it is no longer necessary to cover the hull itself with canvas or tarpaulins because such a cover can be attached to the boat dock itself in a stationary mount.

Such a device can also be equipped for single-handed operation. In this case, a control cable is stretched between the pillars, spanning the width of the device. Then when the hull is guided into the receiving space of this device, the bow of the boat encounters this control cable, which then tightens. This control cable may be arranged on rails running longitudinally so they guide the bow in the longitudinal direction and center it over the support, and simultaneously with the tightening of this control cable, the pump for emptying the floats may be activated, so, in addition, the entire device is raised into its elevated position at the same time.

The floats mentioned above are safe for use in ice and are preferably made of aluminum or plastic bodies, rubber elastic bodies or thin steel bodies. The other parts of the device are preferably made of aluminum, iron or plastic sections.

When several of these devices are combined, they can form a complete docking system. so it is now much easier to dock a variety of boats in one dock system.

Another advantage of the entire device is that winter dry docks can now be eliminated and can be replaced with winter docks in water, where only a relatively low depth suffices for these devices to assure that the boat will be in a suitable raised position. Even if the water level drops during the winter, floatability of the device is still assured.

Another advantage of this device is that the boat is much more theft-proof because the pumps and their electric power supply can be permanently secured and then it is no longer possible to steal the boat when it is out of water.

In another preferred embodiment of the invention, the height adjustment device for boats consists only of two tubes that accommodate the hull and are arranged so they are parallel to each other and stationary at the external distance of the ship's greatest width— on a pier, for example— and these tubes can be raised by means of the respective pumps and can be lowered by flooding, so a boat can remain docked on these tubes above the water level throughout the year when the tubes have been pumped empty. This boat lift yields the important advantage that it costs the boat owner much less than a winter dock and furthermore it is no longer necessary to apply antifouling paint, and finally is it not necessary to remove algae from the underwater hull.

Additional advantages for the boat owner include the fact that it is no longer necessary to set the mast, and transportation from the pier to the winter dry dock and back again is eliminated. Similarly, no crane fees are necessary, nor is there any risk of osmosis.

In addition, the boat need not be occupied when docking, and instead it can be docked single-handedly. A boat docked in this way is sea-ready with just a couple of manipulations. and the underwater hull can be inspected without raising it with a crane. This preferred boat lift can also be equipped with a burglar alarm.

This embodiment of the present invention also has some significant advantages for the dock operator because now the dock can be leased out even in the winter, and the winter dry dock areas can be utilized more profitably, especially in the area of the pier.

Maintenance work on boats can now be distributed uniformly throughout the year. thus preventing bottlenecks, especially in the spring and fall.

With this boat lift system, boats can be docked closer together and a dolphin is no longer necessary.

Finally, it is also possible to use these boat lift systems as displacement systems, so more boats can be accommodated in a given area of water.

This preferred boat lift system also has some important advantages for environmental protection, since there are no longer any toxic paints to pollute drinking water, no toxins enter the environment when sanding and washing the underwater hull when the boat is docked on these tubes and furthermore the buoy fields can be arranged in docking islands with this boat lift system.

BRIEF DESCRIPTION OF THE DRAWING

The objects, advantages and features of this invention will be more clearly understood from the following detailed description, when read in conjunction with the accompanying drawing, in which.

DETAILED DESCRIPTION OF THE PREFERRED EMBODIMENTS

Figure 1:
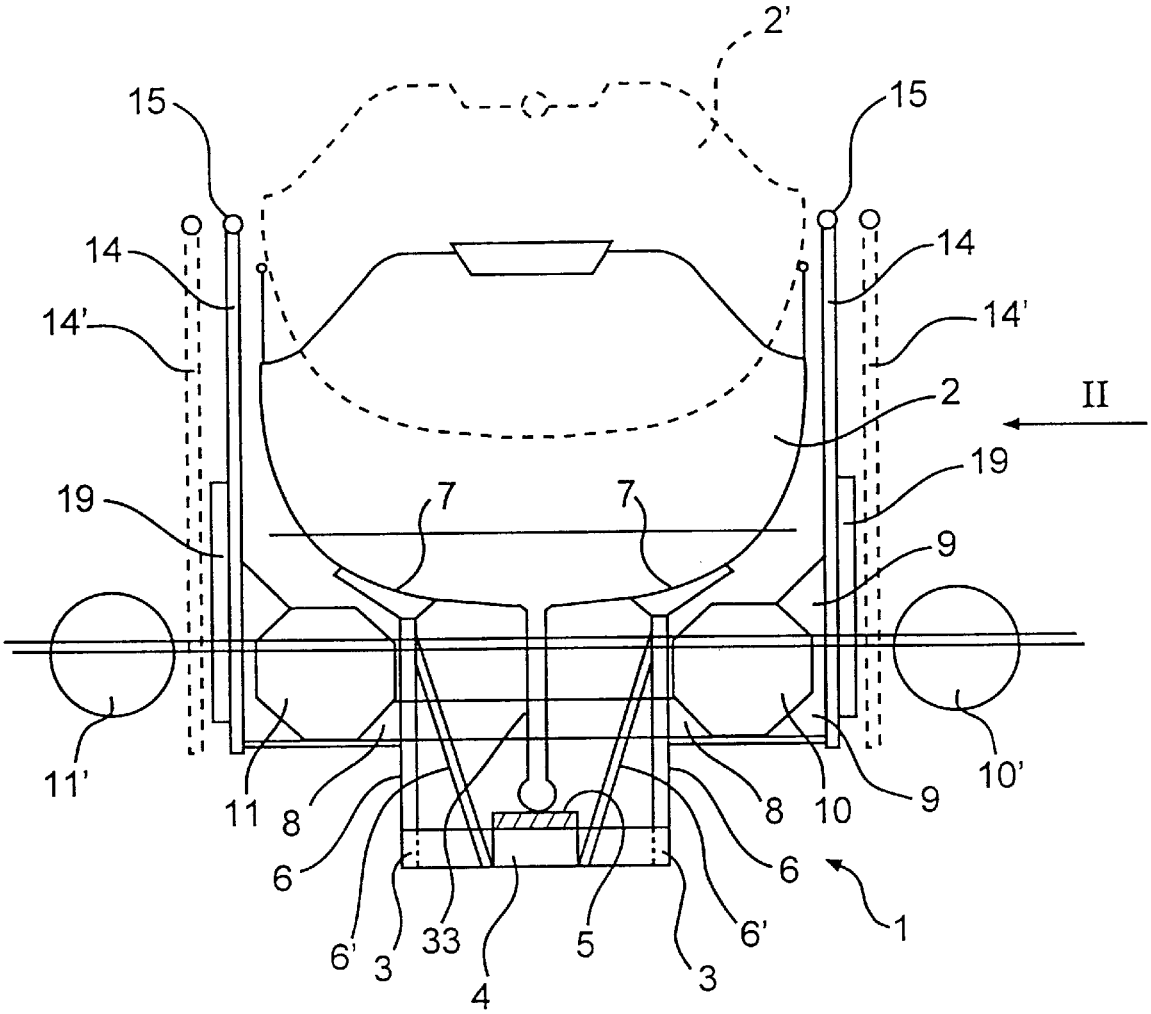
FIG. 1 is a front view of apparatus constructed according to this invention.

With reference now to the drawing, the apparatus consists essentially of a lower central, submersible support 1 that in turn consists of two parallel longitudinal bars 3 connected together by cross arms 4 at certain intervals. Keel pillar 5 is provided between longitudinal bars 3 and is designed so it is adjustable in the longitudinal direction between the longitudinal bars.

Ship's hull 2 with its underwater hull and keel 33, if any, is then run onto support 1. There are a plurality of generally vertical pillars 6 that project upwardly from longitudinal bars 3 and have supporting plates 7 on the free upper ends to form a cradle means to support the hull of a boat. Appropriate diagonal or transverse braces 6' may also be provided from pillars 6 to cross arms 4 according to FIGS. 1 and 2. Side gusset plates 8 may also be provided on the outside of pillars 6, where they are attached to the pillars and are suitable for attaching appropriate floats 10, 11. These floats on either side of the support are an important aspect of the invention and accommodate the keel in the longitudinal direction.

Each float 10, 11 extends approximately over the entire length of the device and is attached to side pillars 12, 14 with additional external gusset plates 9. The embodiment illustrated in FIG. 1 shows how floats 10. 11 may be made of hexagonal or polygonal sections. for example. Another embodiment is also illustrated in FIG. 1 where floats 10', 11' may be designed with a round or cylindrical shape. They may also be oval, elliptical or any other desired shape. The only important thing is that they should have compartments that are preferably separated from each other, where each compartment has its own pump 30 (see FIGS. 4 and 6). For example, FIG. 4 shows float compartments 10*a* and 10*b*.

Pillars 12, 14 project upwardly and are adjacent to side gusset plates 9. Pillars 12 are longitudinally centrally located and are connected directly to support 1, while pillars 14 are adjacent the longitudinal ends of the apparatus and connected to floats 10, 11. The connection between support 1 and floats 10, 11 is also established by two cross arms 24, 25 that are longitudinally spaced from each other.

Front pillars 14 are attached to front cross arm 24 and displacement mount 18 to which bracket 17 is attached is also provided on these pillars. Bracket 17 is arranged so it is adjustable in height on front pillar 14 and it is attached to mooring point 34 which is external of the apparatus of the invention. This connection to the mooring point may be referred to as an articulated joint. The mooring point may be geographically stationary, or relatively stationary with respect to the support of the invention.

FIG. 1 also shows that similar neighboring devices can be connected to the device shown with solid lines in FIG. 1 by an appropriate displacement mount or linking means 19, where this displacement mount assures a mutual adjustability in height of the devices that are coupled together. The neighboring devices are merely indicated schematically by floats 10', 11' and the respective pillars 14'.

Figure 2:
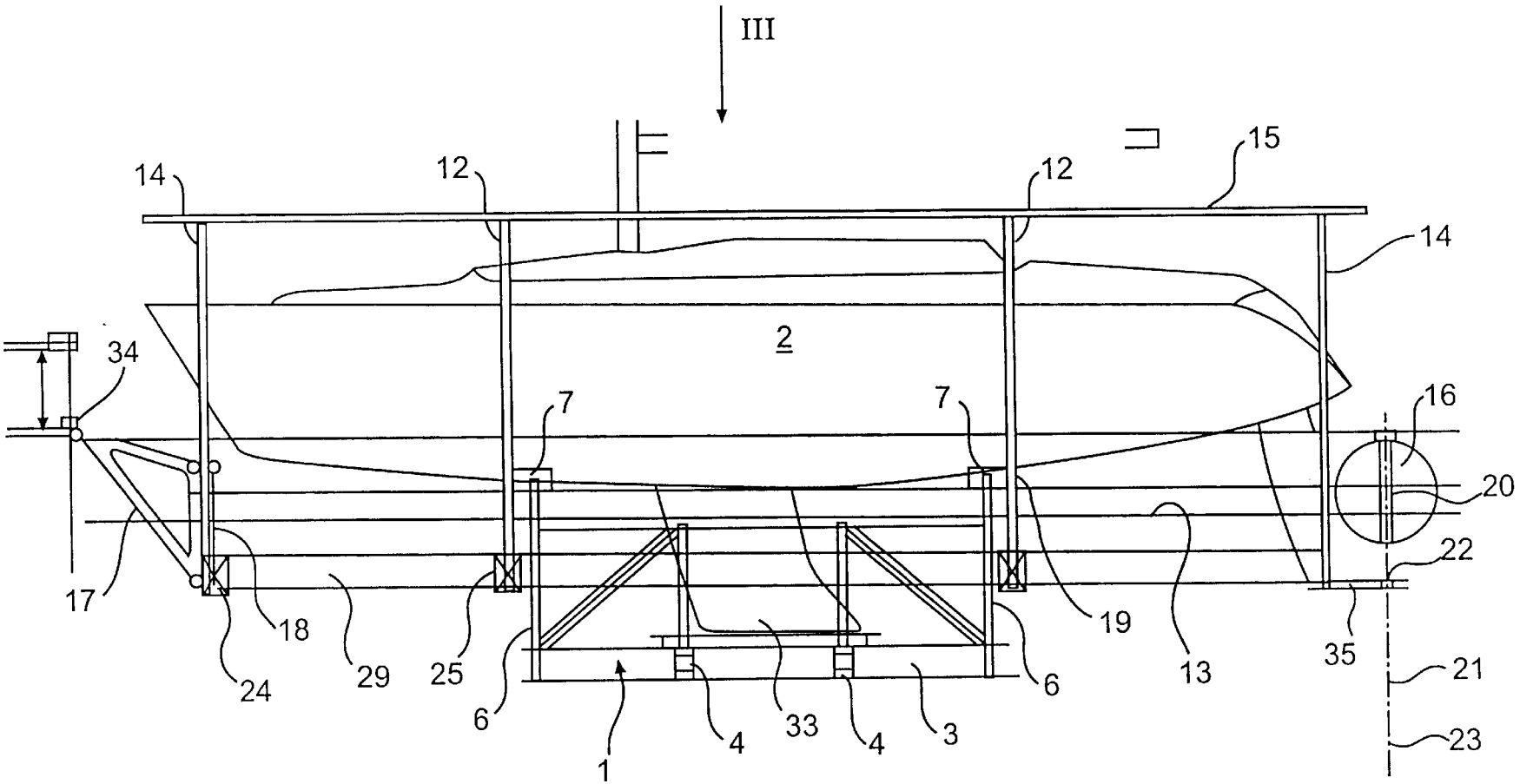
FIG. 2 is a side view of the apparatus of the invention as seen in the direction of arrow II in FIG. 1.

FIG. 2 illustrates the raised position of the device because most of the hull of the boat (except for keel 33) is above water line 13. This also shows that pillars 12, 14 are connected to each other by hand rails 15 running in the longitudinal direction.

The rear part of the device that extends into the water is stabilized by buoy 16 or by another float. In the embodiment illustrated here, chain 21 passes through central recess 20 in buoy 16 and through borehole 22 provided in horizontal extension 35 of the lower base point of pillar 14. Chain 21 has lower stop 23.

When the entire device is flooded by pumping water into the different chambers of floats 10, 11 using pumps 30, the entire device sinks into the water together with carriers 35 that have boreholes 22. Then stop 23 comes to rest against the under side of carrier 35, because it will not pass through borehole 22, and now floating buoy 16 supports the rear part of the device in the submerged state and thereby stabilizes the entire device.

Figure 3:
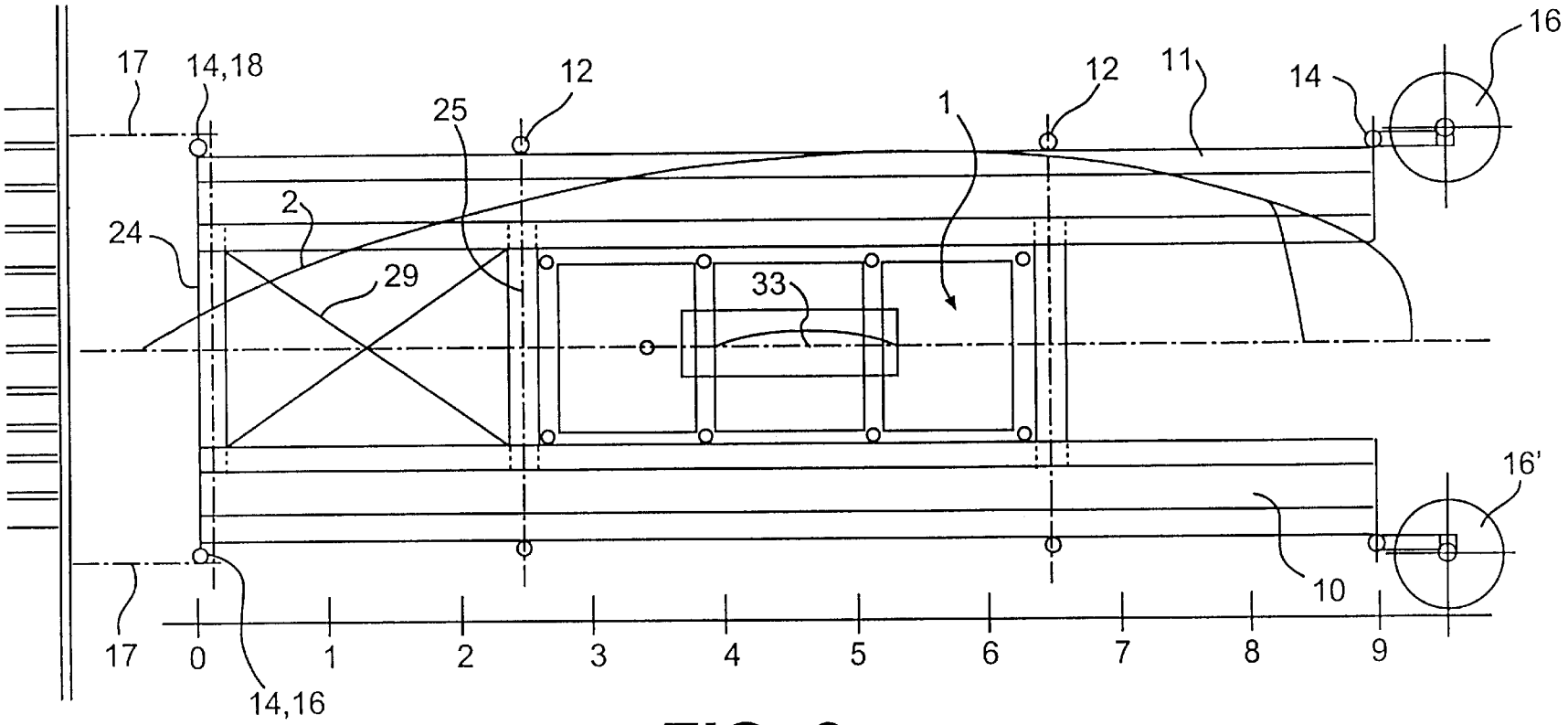
FIG. 3 is a top view of the invention taken in the direction of arrow III in FIG. 2.

According to FIG. 3, it is also important that the neighboring device uses the same buoy 16, so the device has right and left buoys 16, 16',and each buoy is also shared by the neighboring device, which is connected directly to the device described above by displacement mount 19 so it is adjustable in height, as mentioned above. Also shown in FIG. 3 is a reference length scale represented as a line with spaced numerals 0–9. The length could be in meters or some other convenient unit.

Figure 4A:
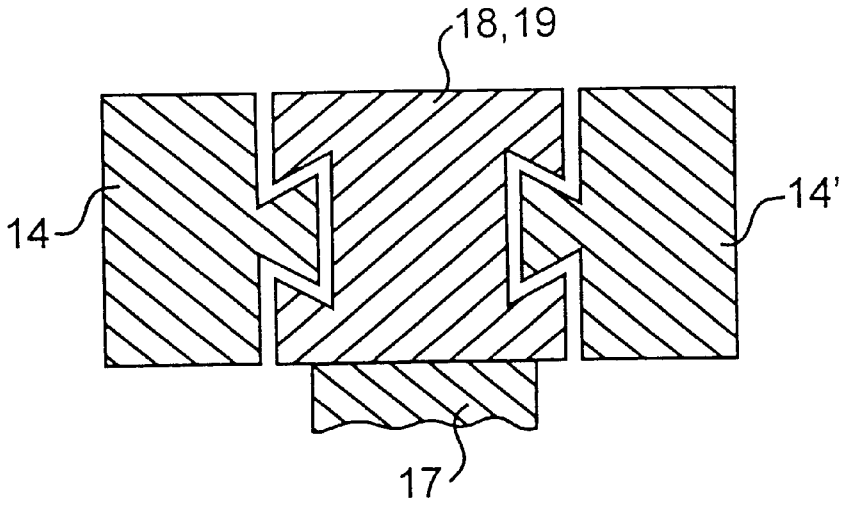
FIG. 4A is a section through a displacement mount with a dovetailed guide for the pillar shown in FIGS. 1–3.
Figure 4B:
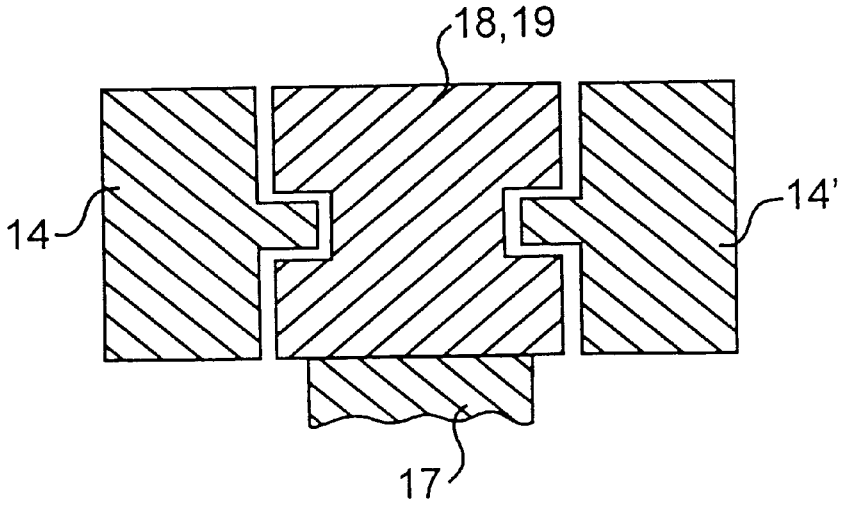
FIG. 4B is a section through an alternative displacement mount having a tongue-and-groove guide for the pillar shown in FIGS. 1–3.
Figure 4C:
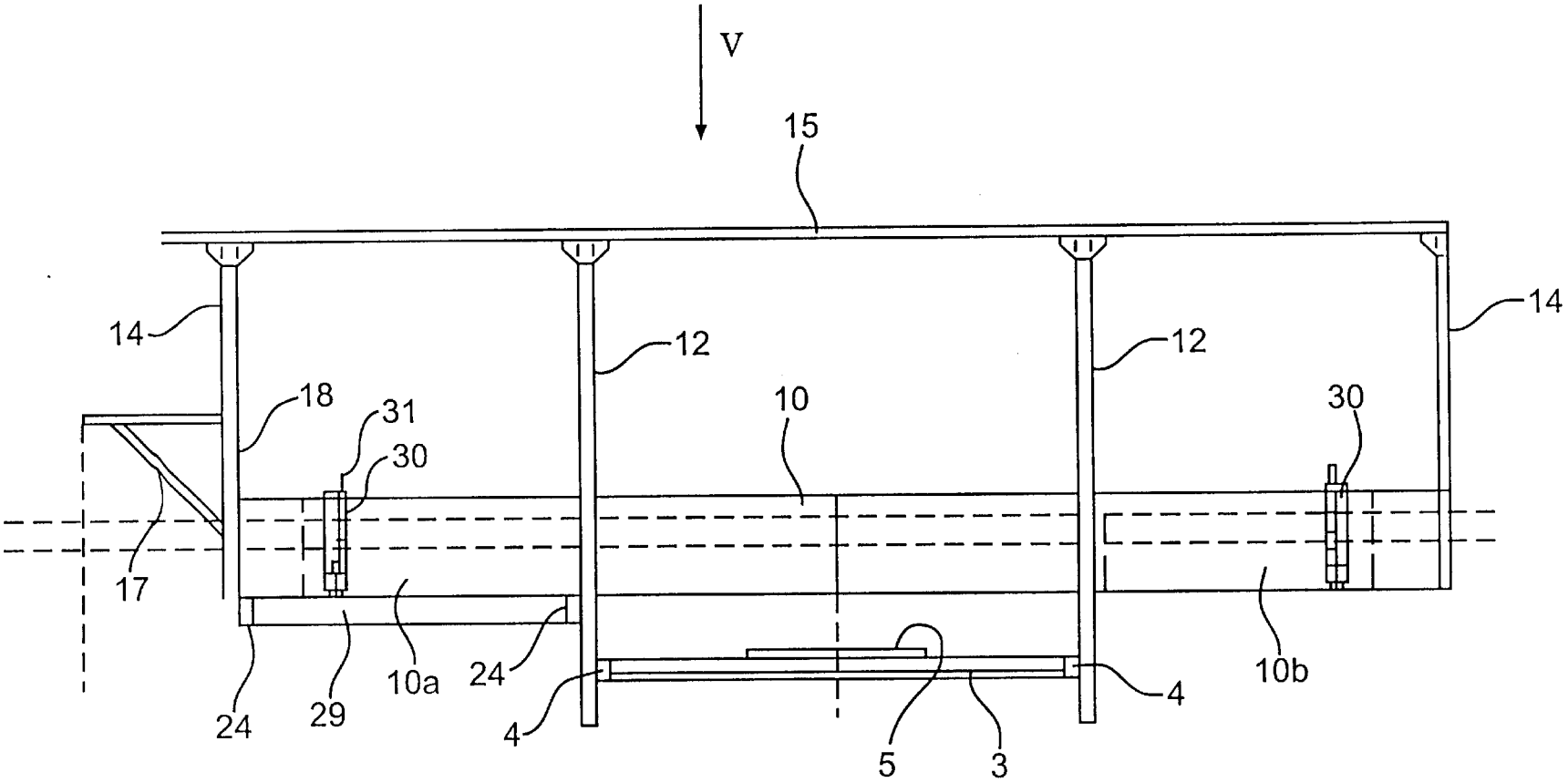
FIG. 4C is a side view of the embodiment of the FIGS. 1–3 apparatus, not showing the boat's hull, taken in the direction of arrow IV in FIG. 5.
Figure 5:
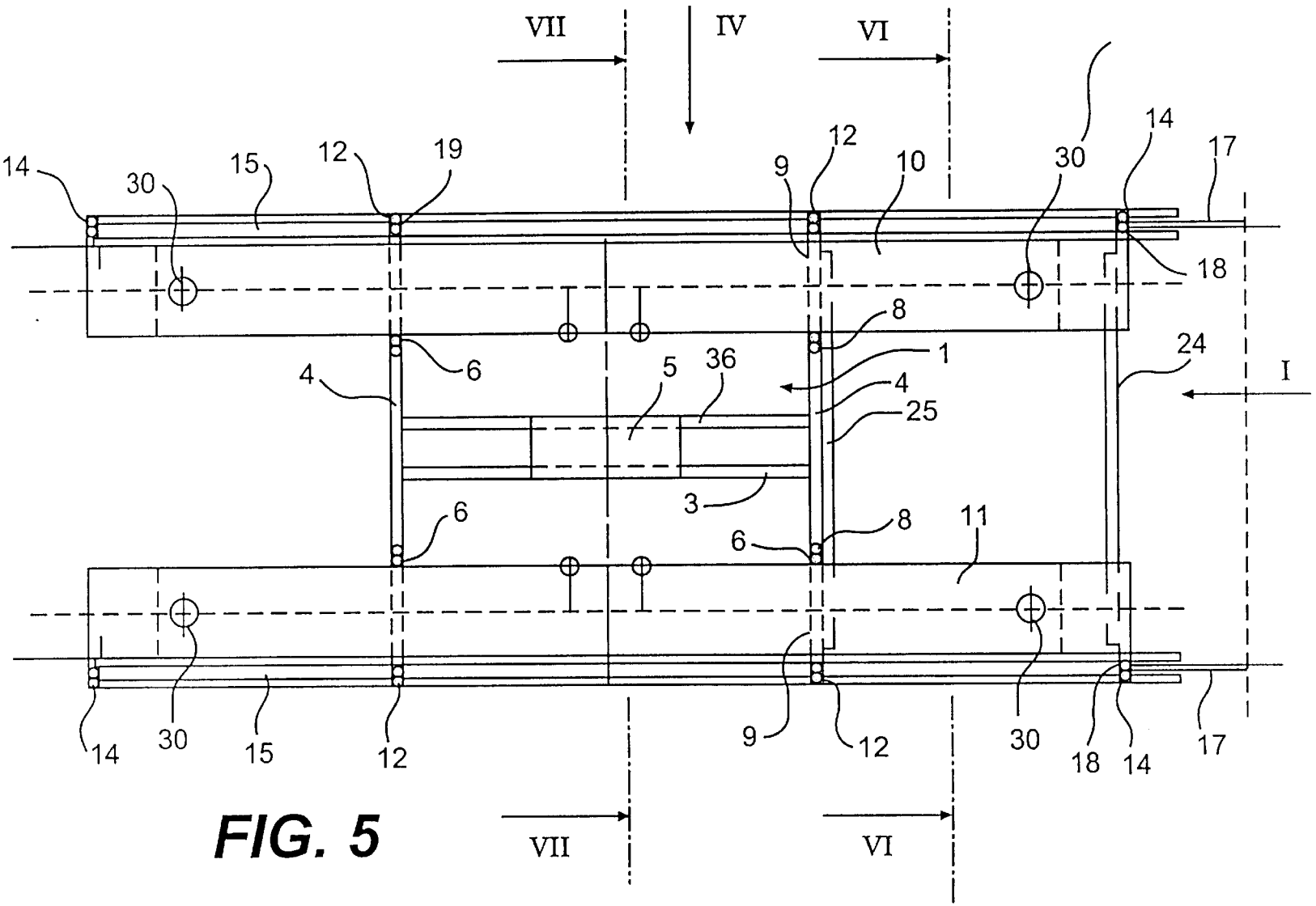
FIG. 5 is a top view of the apparatus of FIG. 4 taken in the direction of arrow V.

FIGS. 4A and 4B show two other possibilities of guiding pillars 14 and 14' in displacement mount 18 and 19. FIG. 4A shows the possibility of a dovetailed guide which has the advantage that pillars 14 and 14' are connected displaceably but undetachably to displacement mount 19. Pillars 14 and 14' are pillars of adjacent devices. FIG. 4B shows a tongue-and-groove guide for pillars 14 and 14' in displacement mounts 18, 19.

Furthermore. the entire usable width of the device can be adapted to the given boat width because of the fact that cross arms 24, 25 are designed so they are adjustable in the direction of arrows 26. 27 (FIG. 6) and have appropriate securing options.

Figure 6:
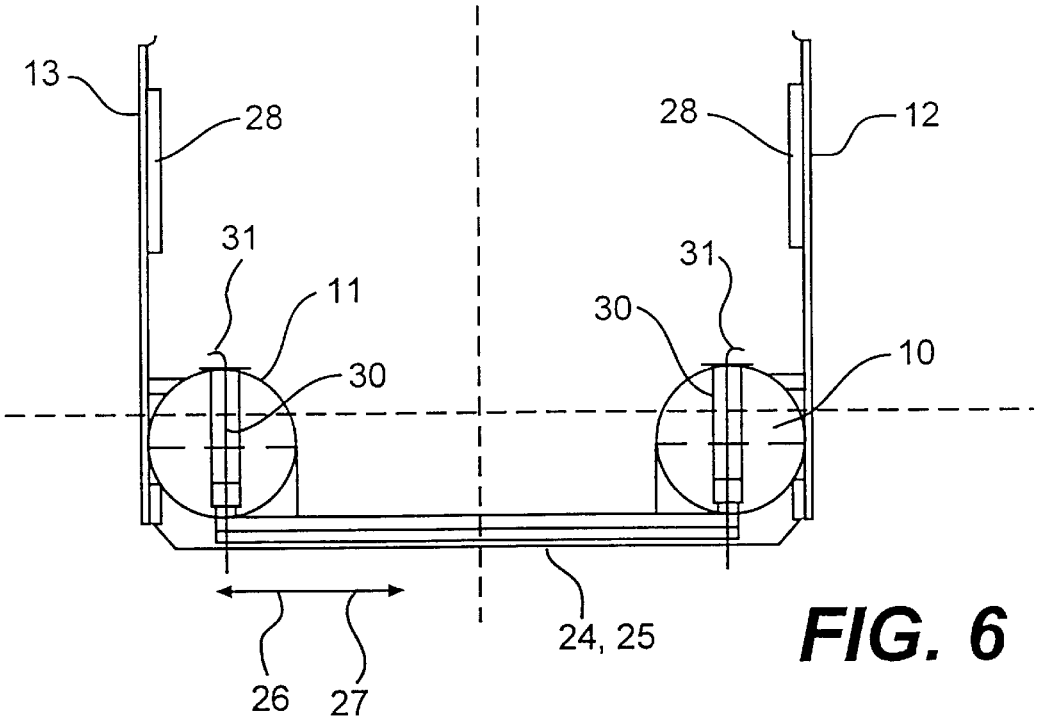
FIG. 6 is a sectional view taken along cutting plane VI—VI in FIG. 5.

FIG. 6 also shows that submersible pumps 30 have appropriate outlets 31 through which the water is pumped out of the corresponding compartments of floats 10, 11. Likewise. pumps 30 and outlets 31 incorporate means for appropriate venting and aerating to assure that air is drawn into the floats as the water is pumped out. Fenders 28 are preferably arranged on the inside of pillars 12, but they need not necessarily be in contact with the hull of the boat itself.

Appropriate diagonal struts 29 may be provided between cross arms 24, 25 for reinforcement purposes. A similar strut arrangement could be provided between longitudinal bars 3, if desired.

Figure 7:
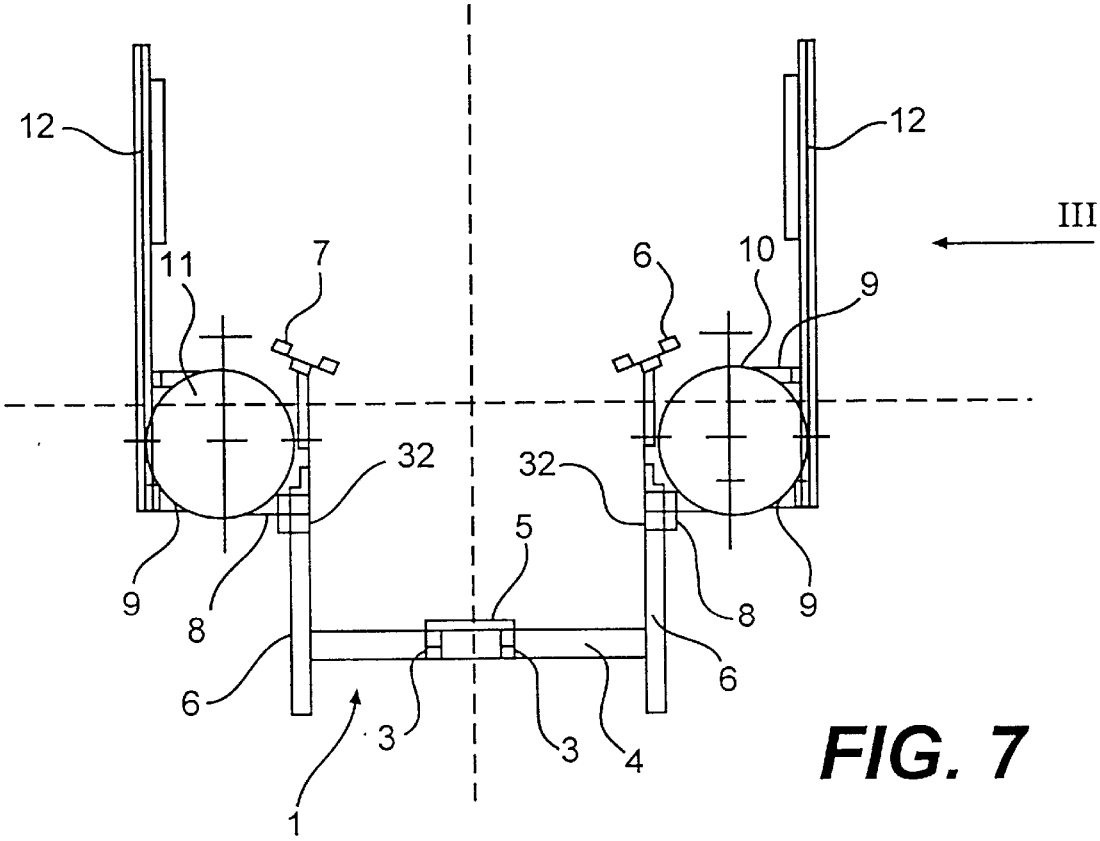
FIG. 7 is a sectional view taken along cutting plane VII—VII in FIG. 5.

To adapt the depth of immersion of the device to different depths of the boat hull 2 to be raised, FIG. 7 shows that the entire support 1 with its side pillars 6 is attached to inside gusset plates 8 by means of height adjustment devices 32. This makes it possible to adjust the depth of immersion of the support to the depth of the hull for each individual boat.

Figure 8:
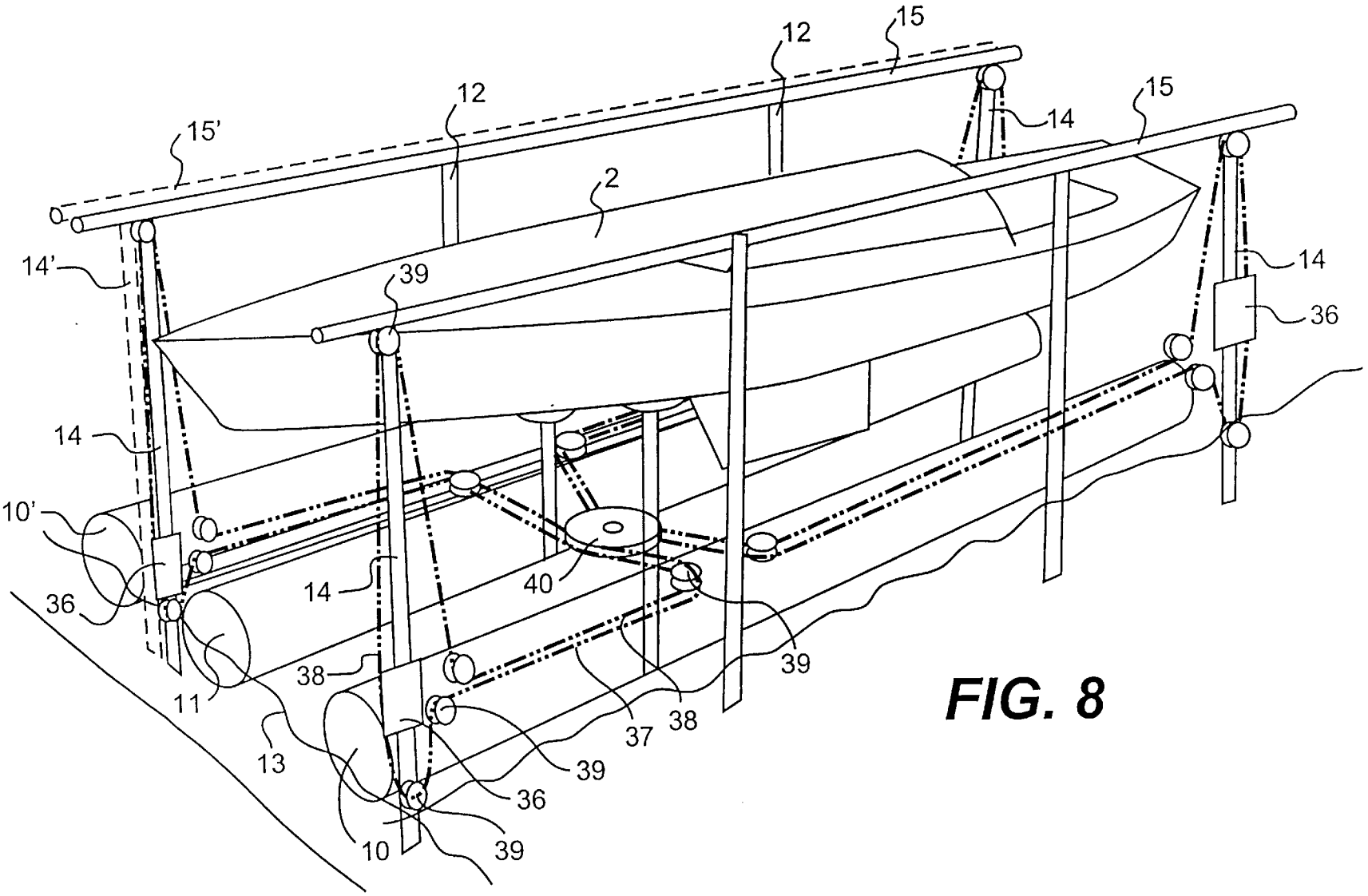
FIG. 8 is a perspective view of an alternative embodiment of the device according to the invention, having synchronization.
Figure 9:
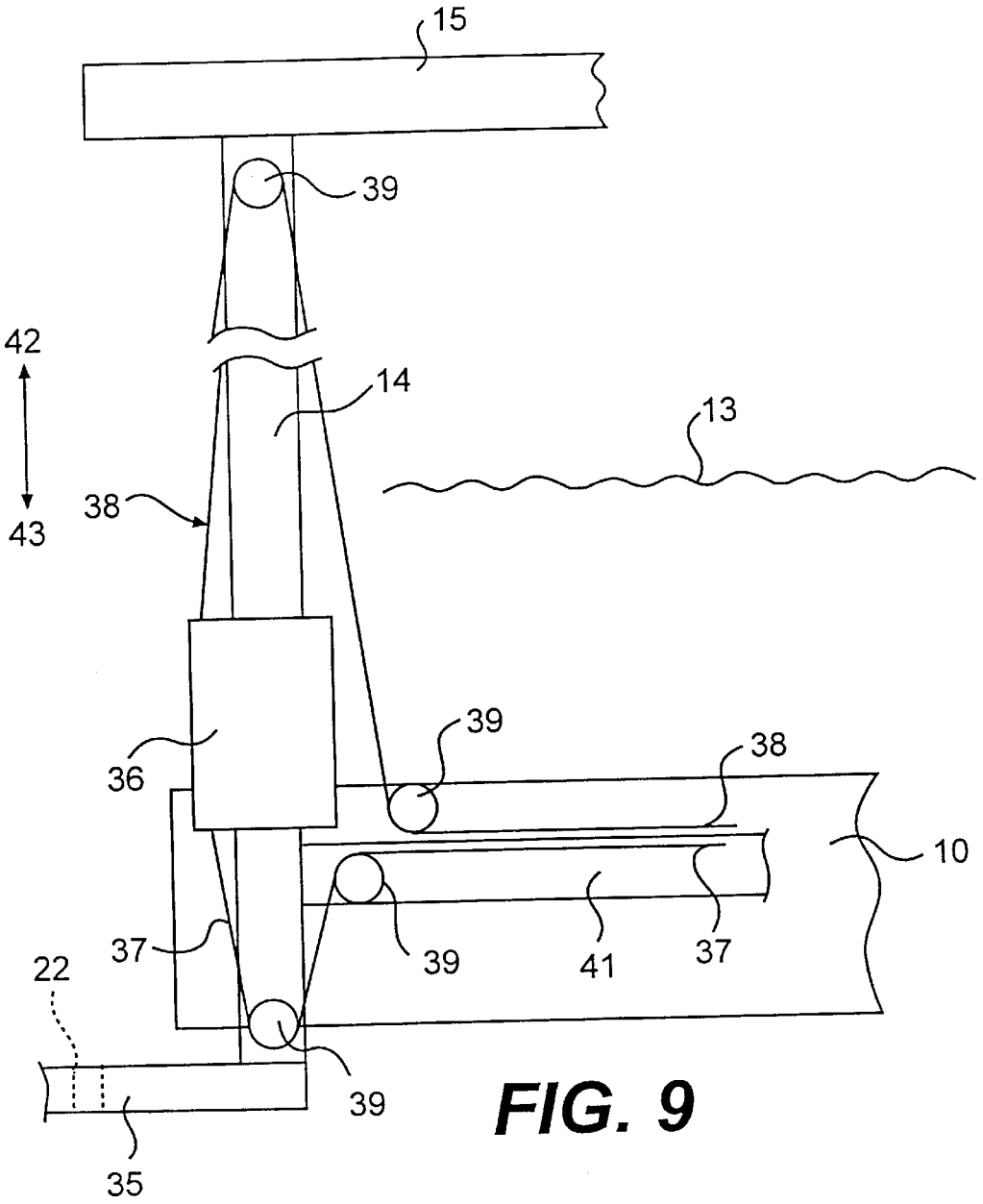
FIG. 9 is a side view of a pillar of the invention shown in FIG. 8.
Figure 10:
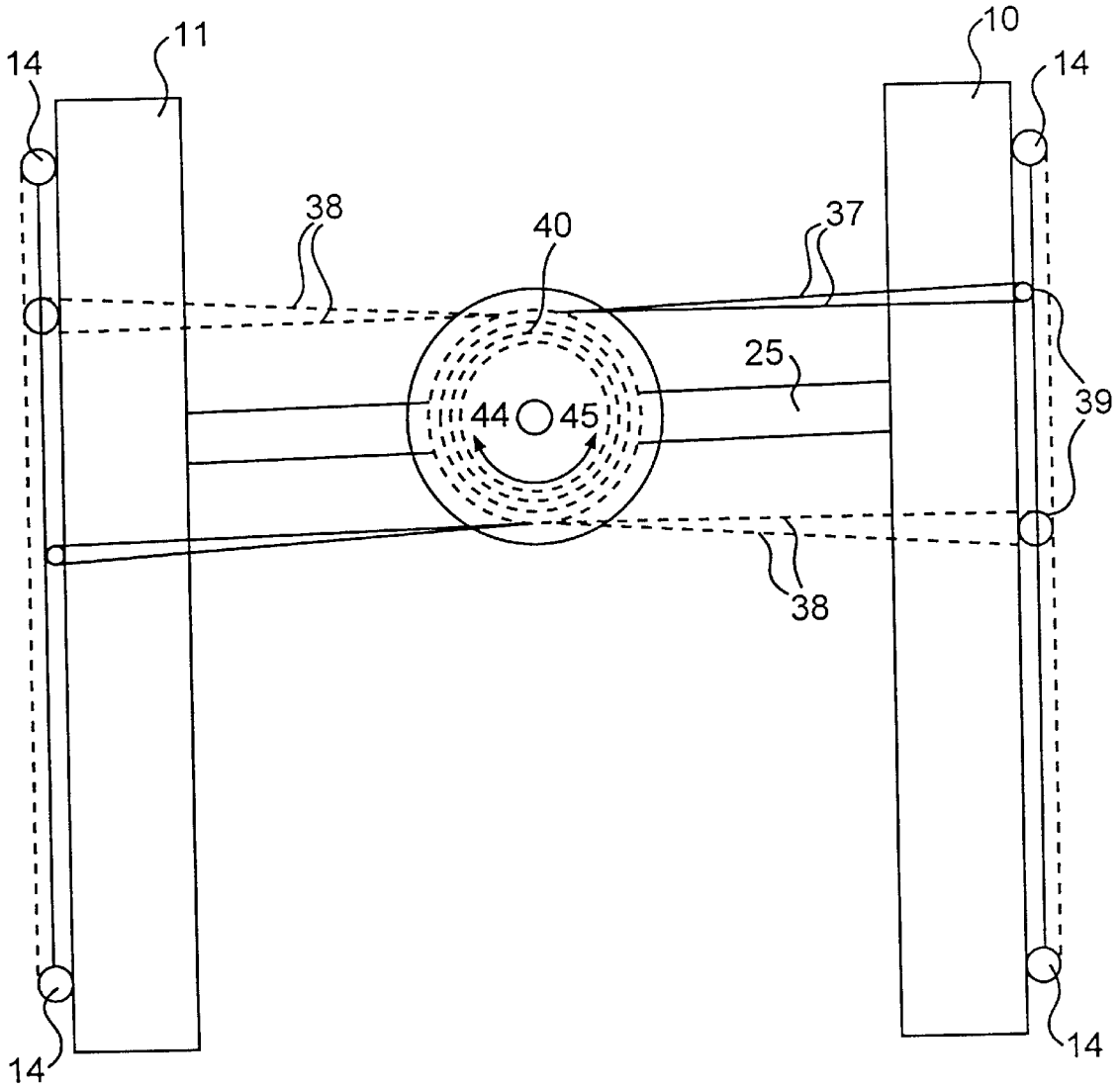
FIG. 10 is a top view of the device according to FIG. 8, where some of the components are not shown for purposes of clarity.

FIG. 8 is a perspective view of a device according to this invention with synchronization. This synchronization prevents tilting in raising/lowering. Additional details of the synchronization are shown in FIGS. 9 and 10.

Adjacent devices are connected to one another over at least four roller boxes 36. three of which are shown in FIG. 8. The roller boxes 36 reach around adjacent pillars 14, 14' of adjacent devices, as detailed in FIG. 11, and are essentially undisplaceable with respect to water line 13 (see FIG. 9).

As shown in FIGS. 9–13. each roller box 36 is connected at its bottom to a traction mechanism 37, for example. a cable or a chain. and at its top to a traction mechanism 38, which could also be a cable or a chain. Traction mechanisms 37, 38 are deflected over rollers 39 and extend over the entire displaceable length of pillar 14. They are guided over additional rollers 39 to a rotary disk 40 (FIG. 10), which is mounted on cross arm 25 so that it can rotate in the direction of arrows 44, 45. For the sake of a better overview, traction mechanisms 38, which are attached to the top of roller boxes 36, are shown with dotted lines in FIG. 10. Rollers 39 can be attached to floats 10, 11 at struts 41 or at other parts.

Figure 13:
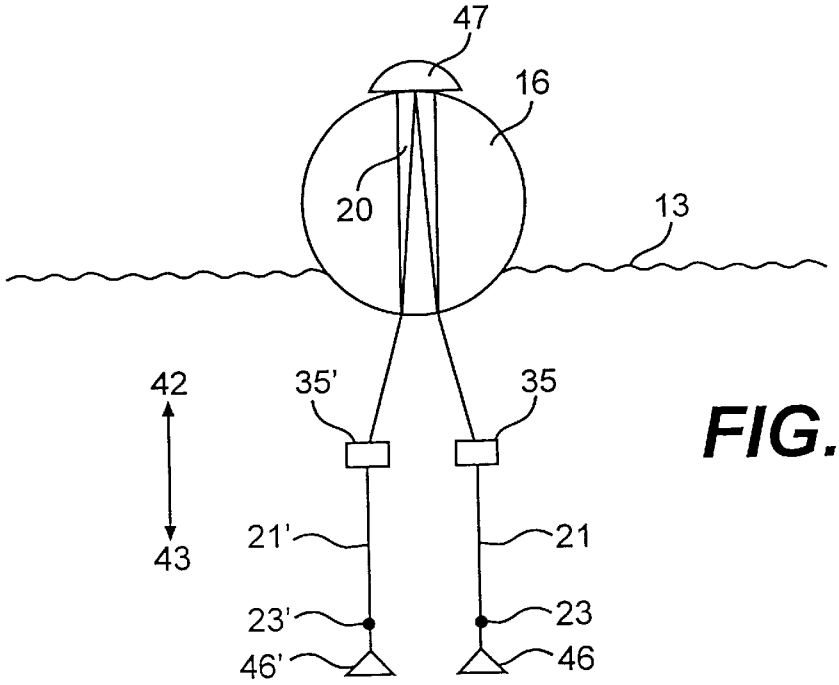
FIG. 13 a view of a buoy with two chains as employed in the invention.

If the entire device is to be raised in the direction of arrow 42, shown in FIG. 13, floats 10, 11 are filled with air or water is pumped out. The resulting buoyancy causes a displacement of pillars 14 in the direction of arrow 42. This automatically exerts a tensile force on the lower traction mechanisms 37, which turns rotary disk 40 in the direction of arrow 44 accordingly. Due to this rotation, the top traction mechanisms 38 are released, and pillars 14 can move upward in the direction of arrow 42.

The changes in length or, to be more precise, the displacement paths of traction mechanisms 37, 38, are identical here. The individual pillars 14 are linked by traction mechanisms 37, 38. Thus vertical synchronization occurs and it is impossible for one pillar 14 to be raised more quickly or more slowly than the other pillar 14. Tilting is thus reliably prevented.

For lowering in the direction of arrow 43, floats 10, 11 are flooded, and the process takes place in the opposite order, with rotary disk 40 being turned in the direction of arrow 45. Synchronization is thus also operative in lowering Roller boxes 36 remain essentially at the same level with respect to water line 13 because of traction mechanisms 37, 38. They serve as fixed points for raising and lowering a boat. Roller boxes 36 have the same function as displacement mounts 18, 19 according to FIGS. 1–3 and they can replace them.

Figure 11:
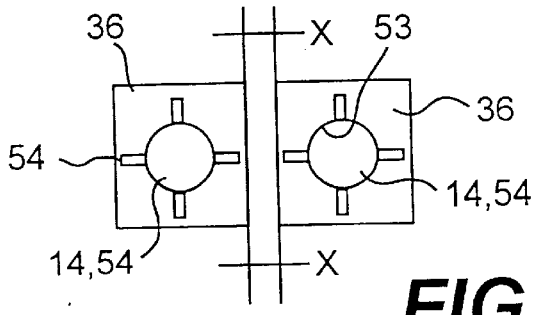
FIG. 11 is a top view of two interlinked roller boxes of the invention shown in FIG. 8.

FIG. 11 shows two roller boxes 36 linked together. This coupling is desirable in one embodiment, because in this way, any desired number of devices can be arranged side by side. Each roller box 36 is essentially cuboid in design with a recess 53, which is suitable for accommodating a pillar 14. Each roller box 36 is also provided with at least two rollers 54 which are mounted so they can rotate in roller box 36. Pillars 14 are supported on these rollers. In raising or lowering a boat, rollers 54 are rotated, so that pillars 14 can move in roller boxes 36 with almost no friction.

Figure 12:
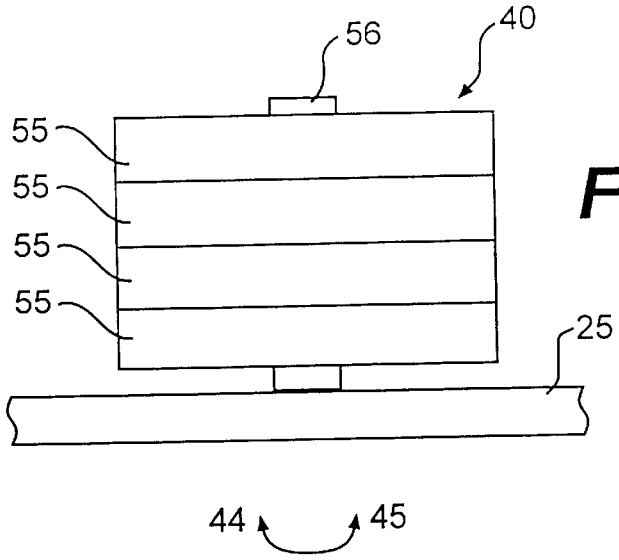
FIG. 12 a side view of a rotary disk shown in FIG. 10.

FIG. 12 shows a side view of a rotary disk 40. Rotary disk 40 must accommodate a total of eight traction mechanisms 37, 38, namely two per corner pillar 14, with two mechanisms being reeled in or unreeled jointly. Therefore, it is sufficient to arrange a total of four receptacles 55, one above the other, on rotary disk 40. Rotary disk 40 is mounted on a shaft 56 which is in turn mounted on cross arm 25 so that the disk can rotate in the direction of arrows 44, 45.

Each receptacle 55 can accommodate two traction mechanisms 37 and 38. Only one type of traction mechanism, that is, either traction mechanism 37 or traction mechanism 38. is accommodated in each receptacle 55. Either traction mechanism 37 or 38 which acts on the same side of rotary disk 40 can be combined, or opposing similar traction mechanisms 37 and 38 which then cover one another can be combined.

FIG. 13 shows a view of a buoy 16 which is suitable for use with two devices arranged side by side. Buoy 16 has a central recess 20. Two chains 21, 21' which are mounted on a fastener 47 run in central recess 20. The right chain 21 serves for a first device, the left chain 21' serves for another device which is linked to the former. Both devices extend around chain 21, 21' with their respective carriers 35, 35'. One weight 46, 46' is provided for tightening each chain 21, 21'. It is clear that the two devices can be raised and lowered independently of one another in the direction of arrows 42, 43.

Figure 14:
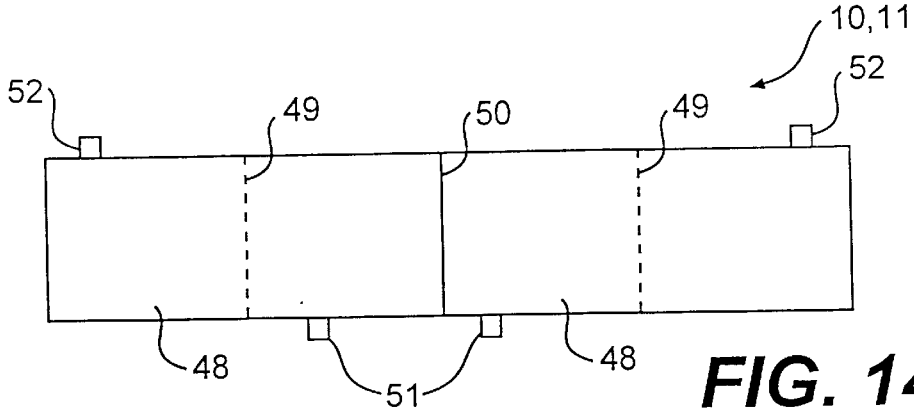
FIG. 14 is a diagram of a float portion of the invention.

FIG. 14 shows a float 10, 11. Float 10, 11 is subdivided into two essentially identical chambers 48 separated by a watertight partition 50. At least one water-permeable baffle 49 is provided in each chamber 48. These baffles serve to retard movement in chamber 48 of water accommodated in chamber 48. Each chamber 48 also has a connection 51 for supplying compressed air and a valve 52 for flooding chamber 48. All connections 51 and all valves 52 are preferably operated together to permit rapid raising or lowering.

In view of the above description, it is likely that those skilled in the art will envision modifications and improvements in this invention. The invention is limited only by the spirit and scope of the accompanying claims, with due consideration being given to a reasonable range of equivalents.

What is claimed is:

1. An apparatus adjacent to a stationary mooring point for raising and lowering boats in water, the apparatus comprising:

a submersible support having a longitudinal axis coinciding with a longitudinal axis of a boat which it is adapted to support;

adjustable cradle means for supporting a hull of the boat, the adjustable cradle means adjust ably coupled to the submersible support to accommodate boat hulls of different dimensions, the adjustable cradle means comprising:

a hull support; and a keel support;

at least two submersible float members secured to the submersible support; and an articulated joint means for movably coupling the submersible support to the mooring point, the joint means being configured to be adjustable in height with respect to the submersible support.

2. The apparatus according to claim 1, wherein the adjustable cradle means is vertically adjustable connected to the submersible support to accommodate boat hulls of different vertical dimensions.

3. The apparatus according to claim 1 or 2, and further comprising linking means for coupling together adjacent submersible supports, the linking means being configured in such a way that the respective coupled together submersible supports are adjustable in height relative to each other and can be displaced vertically relative to each other. enabling the coupled together submersible supports to be submerged or floated and raised independently of each other.

4. The apparatus according to claim 3, wherein the independent adjustability of the coupled together adjacent submersible supports is accomplished by mutually engaging a dovetailed guide or tongue-and-groove means on each coupled together adjacent submersible support.

5. The apparatus according to claim 1 or 2, wherein the adjustable cradle means comprises:

at least two parallel longitudinal bars;

cross arm members connecting the longitudinal bars together; and a keel support mounted between the longitudinal bars the keel support being adjustable in the longitudinal direction between the longitudinal bars.

6. The apparatus according to claim 1 or 2, wherein the float members extend longitudinally substantially coextensive in length with the submersible support, the submersible support further comprising:

a plurality of upwardly extending side pillars arranged along opposite longitudinal sides of the submersible support;

a hand rail running in the longitudinal direction and interconnecting the top ends of the side pillars on each side of the submersible support;

the side pillars comprising end pillars adjacent to the longitudinal ends of the support, the end pillars being connected to the float members, and comprising middle pillars between the end pillars, the middle pillars being directly connected to the submersible support.

7. The apparatus according to claim 6, wherein the float members are formed with independently fillable and emptiable separate compartments with means for selectively supplying air to and removing air from the compartments.

8. The apparatus according to claim 6, wherein the submersible support is connected to the float members by two spaced cross arms at the front end of the submersible support, one of the cross arms being a front cross arm, one pair of the end pillars being front pillars, the front pillars being connected to the front cross arm;

the articulated joint means comprising a displacement mount on each front pillar and a bracket slidably coupled to each the displacement mount to adjust height, each the bracket being adapted to be connected to the mooring point.

9. The apparatus according to claim 1 or 2, wherein when the apparatus is in the raised position, most of the hull of the boat being raised is above the water line, the end of the submersible support farthest from the joint means being stabilized by a float means, there being means coupled to the float means for restricting the downward travel of the submersible support with respect to the float means.

10. The apparatus according to claim 9, wherein two or more of the apparatus can be positioned adjacently.

11. The apparatus according to claim 1 or 2, wherein the apparatus is shaped and configured as a boat lift wherein the submersible float members comprise two parallel tubes that are adapted to be secured in a stationary mooring, according to the greatest boat width, with assigned buoys, and the tubes can be raised above the water line and lowered by flooding them.

* * * * *